United States Patent [19]

Fox, Jr.

[11] Patent Number: 5,002,496

[45] Date of Patent: Mar. 26, 1991

[54] CAM ACTUATED ELECTRICAL CONNECTOR

[75] Inventor: Roy W. Fox, Jr., Williston, Vt.

[73] Assignee: Middleburg Corporation, Canton, Conn.

[21] Appl. No.: 458,905

[22] Filed: Dec. 29, 1989

Related U.S. Application Data

[60] Division of Ser. No. 374,622, Jun. 29, 1989, which is a continuation-in-part of Ser. No. 226,466, Aug. 1, 1988, abandoned.

[51] Int. Cl.[5] ..... H01R 4/64

[52] U.S. Cl. ..... 439/197; 439/260

[58] Field of Search ..... 174/35 GC, 35 MS; 29/857, 868, 869, 870; 439/190, 197, 259, 260, 262, 265, 266, 267, 492, 495, 499, 377, 592, 593, 42, 66, 198, 329, 493, 632

[56] References Cited

U.S. PATENT DOCUMENTS

| | | | |
|---|---|---|---|
| 2,956,258 | 10/1960 | Raddin | 439/197 |
| 4,540,227 | 9/1985 | Faraci | 439/260 |
| 4,626,056 | 12/1986 | Andrews, Jr. et al. | 439/260 |
| 4,629,270 | 12/1986 | Andrews, Jr. et al. | 439/260 |
| 4,743,203 | 5/1988 | Grabbe | 439/260 |
| 4,746,765 | 5/1988 | Mallott | 174/35 MS |
| 4,840,575 | 6/1989 | Matsuoka | 439/267 |
| 4,846,713 | 7/1989 | Matsuoka | 439/260 |

*Primary Examiner*—Neil Abrams
*Assistant Examiner*—Khiem Nguyen
*Attorney, Agent, or Firm*—Chilton, Alix & Van Kirk

[57] ABSTRACT

Apparatus and method for connecting two electrical conductors (102,104) by means of a bladder (110) having a substantially constant volume of confined fluid interacting between a backing member (106) and one of the conductors (104). The bladder forms a compliant membrane surface (108) that transmits fluid pressure nearly hydrostatically from one conductor (104), to the other (102) such that the intimate contact of the surfaces (116) between the conductors provides an improved electrical connection, especially for small scale multi-conductors. A two-step, cam actuated connector (250,300) is disclosed which provides a low pressure wiping action between the conductors before the conductors are locked together, preferably by pressurization of the bladder (218,308).

31 Claims, 10 Drawing Sheets

CAM ACTUATED ELECTRICAL CONNECTOR

REFERENCE TO RELATED APPLICATION

This is a divisional continuation-in-part of copending application U.S. Ser. No. 374,622 filed June 29, 1989, which is a continuation-in-part of U.S. Ser. No. 226,466, filed Aug. 1, 1988, now abandoned.

BACKGROUND OF THE INVENTION

This invention relates to electrical connectors, and particularly to the type used in computers and similar electronic equipment.

In a variety of electronic applications, electrical connections must be made between one or a group of components, such as a circuit board, with one or a group of different components, such as a power source, a data bus, or the like. Commonly, these connections are not made directly between the components, but rather an intermediate connector is interposed between the components, usually the electrical connection between the components and the connector has been accomplished by some form of mechanical spring force between exposed contacts.

Until recently, such spring loading of the contacts was reasonably cost effective and posed few problems. As the size and/or complexity of circuit components and their associated printed or etched circuit conductors shrink, however, the size of the contacts for interconnecting components has also decreased. As the contact width of the electrical conductors and the spaces between the conductors drop to about 0.025 inch and now approach the range of 0.002–0.005 inch, known spring biased connectors cannot be effectively used. The forces required to make a mechanical spring connection between micro chips or miniature circuit boards cannot be provided by the small cross section of the contacts. The result is that a single chip must be mounted in a lead frame or similar device to provide expanded circuit paths and spaces, then the expanded paths must be connected to still another circuit board to expand the spacing enough to communicate with other devices and peripherals.

Another problem encountered not only with small multi-conductors but in larger ones as well, is the difficulty of assuring that all individual contacts associated with a given connection, are properly engaged and in intimate contact for efficient electrical conduction. Known connectors typically rely on rigid mechanical interaction between the connector and the conductors. This results in a wide variation in the force available for engaging individual contacts on the conductors.

Even in connections between single strand conductors, only a portion of the available contacting surfaces are actually mated, the rigid mechanical connector typically producing a distribution of point or line contacts rather than the desired intimate mating of the full contact surfaces.

SUMMARY OF THE INVENTION

Accordingly, it is an object of the present invention to provide an electrical connector system and method for establishing and maintaining electrical contact between components, or other conductive members to be joined, which does not have an inherent minimum line and space limitation that is dependent upon the spring characteristics of the mating contact structures, whether they be beams or sockets.

It is another object of the invention to provide apparatus and method for accomplishing an intimate electrical connection between single conductors or multi-conductors, for both interference fit and zero force fit connectors.

In accordance with the invention, the electrical connector is in the form of a chassis adapted to receive a multi-conductor member insertable along a first direction into a slot in the chassis extending along the second direction. A gland member is mounted in the chassis and extends longitudinally in the second direction. The chassis conductors and the conductors on the multi-conductor member are each oriented in the first direction and spaced apart in the second direction. The chassis includes a locator for receiving the multi-conductor member within the chassis such that the conductors on the multi-condutor and the respective chassis conductors are aligned in the first direction. The chassis conductors are at least partly interposed between the gland member and the slot. An actuator is connected between the chassis and the gland member, for displacing the gland member in a direction opposite to the first direction, from a first position wherein the conductors on the multi-conductor member and in the chassis are spaced apart to a second position wherein the conductors are in respective low pressure contact.

In a more specific embodiment of the invention, a fluid-filled tube or bladder is carried by a recess in the gland member adjacent the chassis conductors. Once the chassis and multi-conductor are aligned, the fluid is pressurized such that the tube bears directly or indirectly against the chassis conductors urging them against and locking them to the corresponding contacts on the multi-conductor.

In a particularly useful embodiment of the invention, the bladder is pressurized by a force balanced technique which compensates for tolerances, differential expansion and other effects due to temperature variations, as well as accumulated effects of wear and cycling. In this embodiment, means are provided for relatively positioning first and second conductors in substantially pressureless contact, with at least one conductor being supported by a rigid backing. "Substantially pressureless contact" as used herein includes mere "kissing" as well as a wiping between the conductors under light pressure. From this initial pressureless contact condition, a balanced force is applied to the other conductor by a increase in pressure of the fluid-filled bladder. The pressure increase in the bladder is transmitted to the other conductors such that an intimate, compliant connection therebetween is formed. The force balance is achieved by means of a spring structure or the like bearing against an exterior surface of the bladder remote from the direct or indirect contact between the bladder and one of the conductors.

The use of a spring as part of the actuating mechanism for increasing the pressure in the bladder, permits the use of a pivoting latch member for displacing a pressure plate or plug against the bladder, while producing an increase in bladder pressure that is substantially predetermined regardless of the displacement of the latch member. This embodiment is well suited for implementation in a chassis having a slot lined with a plurality of flex circuit contacts against which a card edge carrying a plurality of respective multi-conductors is inserted. In the preferred embodiment of this implementation of the invention, a gland member carries the bladder adjacent to and spanning the plurality of flex circuit contacts in the chassis. The multi-conductor edge is inserted into the slot of the chassis so that the respective multi-conductors are in alignment but not in contact. A guide member coupled to the gland is actuated by a cam latch mechanism such that during an initial portion of the movement of the latch, the gland flexes the chassis conductors into low force wiping contact with the edge multi-conductors. As the latch mechanism is further displaced to its locked position, the bladder is pressurized to achieve the high pressure, compliant connection between the chassis and edge multi-conductors. Preferably, the latch edge includes a cam surface which drives pressure plugs against a spring surface which bears against the exterior surface of the bladder, thereby producing a predetermined pressure increase within a range that is substantially independent of the displacement of the cam surface.

BRIEF DESCRIPTION OF THE DRAWINGS

The preferred embodiments of the invention will be described below with reference to the accompanying drawings in which.

DESCRIPTION OF THE PREFERRED EMBODIMENT

Figure 1A:
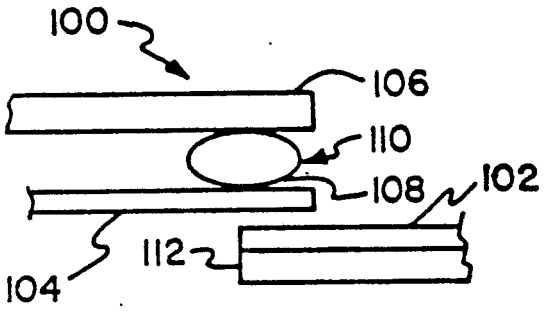
FIGS. 1(*a*) and (*b*) show a generic embodiment of the invention wherein a first conductor is electrically connected to an adjacent second conductor by means of the application of hydrostatic pressure through a membrane, before and after actuation, respectively.
Figure 1B:
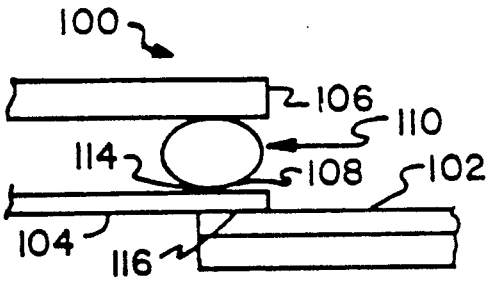

FIG. 1 illustrates the general concept on which the preferred embodiment of the invention is based. Additional background is contained in copending application Ser. No. 374,622 filed June 29, 1989, the disclosure of which is hereby incorporated by reference.

FIG. 1 shows an apparatus and method for making an electrical connection 100 between a first conductor 102 and a second conductor 104. The conductors 102 and 104 are positioned relative to each other and aligned such that the second conductor 104 is in overlapping relationship with the first conductor 102. A backing member 106 is in spaced relation from the second conductor 104 and a compliant membrane surface 108 is positioned between the backing member and the second conductor. In the illustrated embodiment, the membrane 108 is simply an outer wall portion of fluid bladder 110. The bladder can be made from a variety of materials, but thin metal, appropriate elastomers including polyurethane or other materials are suitable, so long as the membrane 108 can transmit pressure nearly hydrostatically as further described below. Typically, a backing member 112 would be in contact with the first conductor 102. Note that when the conductors are first overlapped as shown in FIG. 1(*a*), no electrical contact has yet been made, i.e., this figure illustrates a "zero insertion force" embodiment.

FIG. 1(*b*) shows the connection 100 after the actuation or locking step whereby the fluid in the bladder 110 is pressurized internally. Preferably, the bladder is entirely sealed, so the internal fluid pressure can be increased by the application of a downward force to backing 106 or an upward force to backing 112. Pressurization of the fluid causes the compliant membrane 108 to bear upon the second conductor 104, acting as a fluid spring. The surface area of contact 114 between the membrane 108 and the conductor 104 is relatively widely distributed as compared with the line or multiple point contacts typically resulting from mechanical spring contact. This relatively wide surface area contact pressure is transmitted through the second conductor 104 such that an intimate electrical contact surface 116 is formed between the first and second conductors. The fluid spring effect of the present invention, provides a greatly improved electrical contact between the conductors, as compared with prior techniques.

Figure 2:
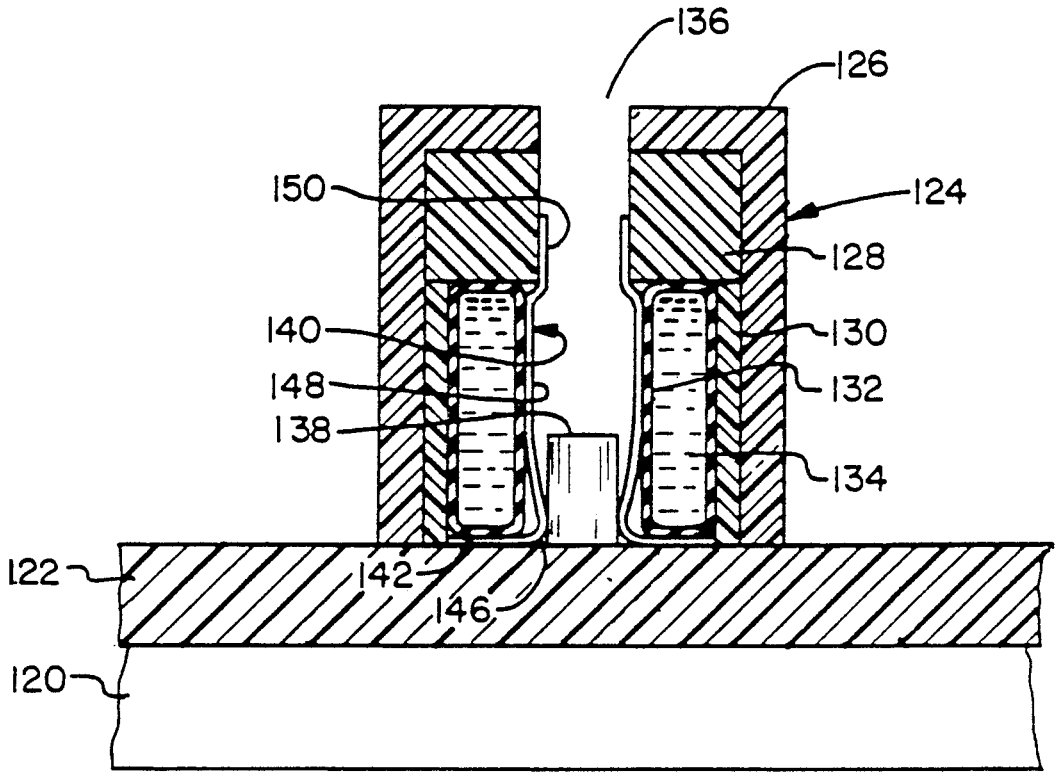
FIG. 2 is an end view, in section, of another embodiment of a connector for "mother" and "daughter" boards in accordance with the invention.
Figure 3:
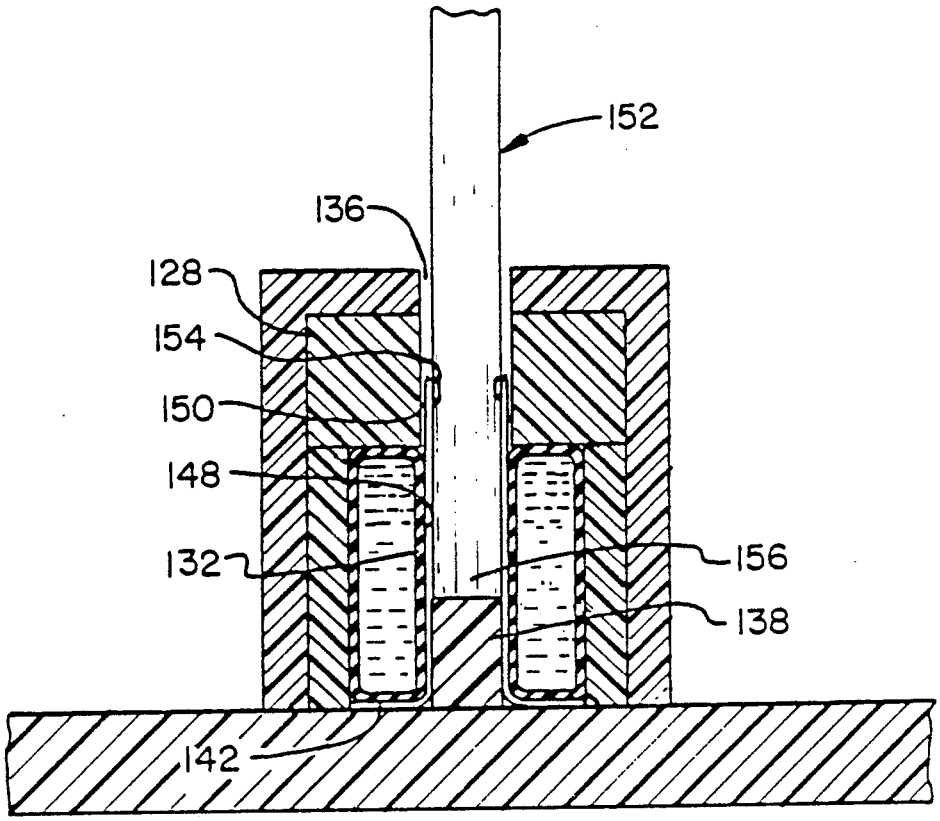
FIG. 3 is a view of the connector of FIG. 2, showing the electrical connection between the mother and daughter boards resulting from the actuation of a fluidic bladder.
Figure 4:
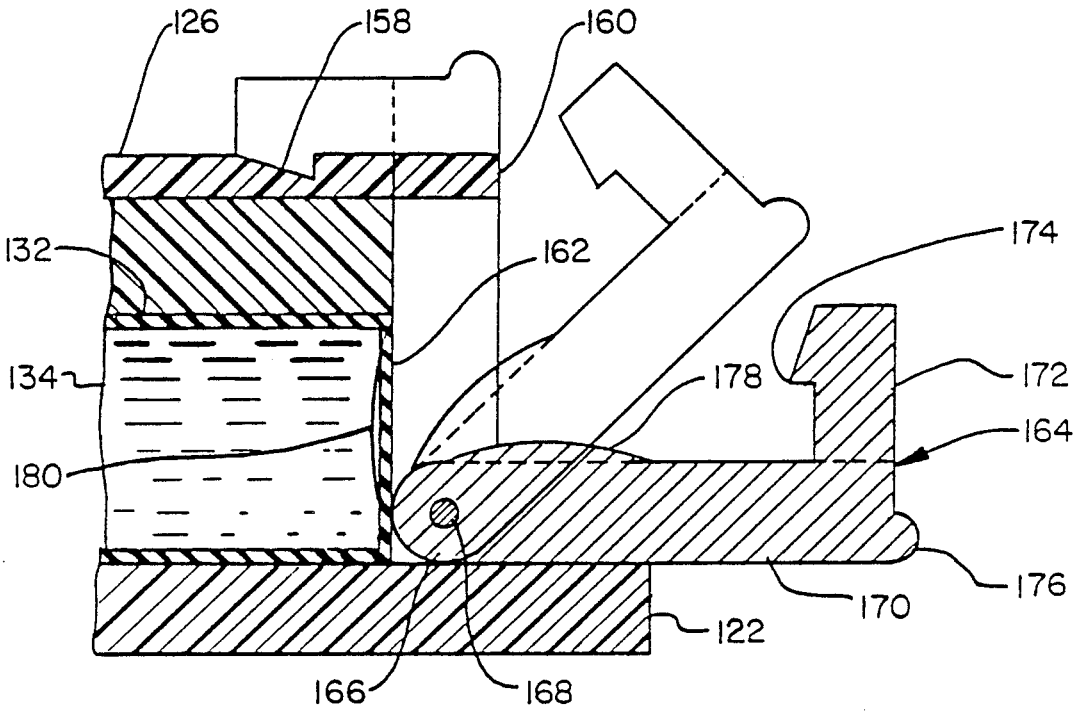
FIG. 4 is a side view of one end of the connector of FIG. 2, showing the operation of a latch lever for pressurizing the fluidic bladder.

FIGS. 2–4 show a variation of the embodiment of FIG. 1, which more closely resembles the preferred embodiment. A mother board 120 includes a contact strip 122 on which one or more connectors 124 are secured. For example, one such connector would typically have a plurality of contacts for receiving a card edge having a similar plurality of contacts.

The connector 124 of FIG. 2 is symmetric about a vertical center line, and includes a stainless steel housing 126 made in the form of spaced apart, "L" shaped angular members, with the free end of the long leg of the "L" abutting the strip 122 and the free end of the short leg of the "L" facing but spaced from each other. In the inside corner between the short and long legs of the housing portion 126, are positioned nonconducting, upper spacer members 128. A substantially rigid backing strip or plate 130 extends longitudinally against the long leg of the housing 126 between the spacer 128 and strip 122. A bladder 132 containing a substantially constant volume of confined fluid 134 extends in contact with the spacer 128 and backing strip 130, with the inner most walls facing each other in space apart relation. The short legs of the housing, the opposed faces of the spacers 128, and the opposed inner walls of the bladder 132, define an edge slot 136, for receiving the daughter board, or card edge as will be described below. A stop rib 138 is located between the bladders 132, in abutting relation with the strip 122, to serve as a stop and/or guide for the leading edge of the card. Preferably, each of the housing 126, spacer 128, backing 130, and bladder 132 are elongated, unitary members which are conveniently bonded together.

A plurality of contact members 140 are positioned in spaced relation (such spacing being in the perpendicular direction to the plane of FIG. 2), in order to receive a corresponding plurality of contacts on the card leading edge. Each contact member 140, preferably includes a foot portion 142 sandwiched between the lower surface of the bladder 132, and strip 122. A lower bend portion 146 contacts the stop member 138 near the lower portion thereof, and has an inverse curvature such that the central portion 148 contacts the inwardly facing surface of the bladder 132. An upper kink terminates in a contact pad 150 that rests on the inner surface of spacer 128. The foot portion 142 of each contact member 140 can be in electrical contact with a lead or other electronic path associated with strip 122 for communication with the mother board 120. When it is desired that a daughter board be electrically connected to the mother board 120, the leading end of the daughter board is inserted into the slot 156, which provides sufficient space for an interference-free fit.

As shown in FIG. 3, the daughter board or card 152 has a plurality of contacts 154 in space apart relation in a direction perpendicular to the plane of the paper, such spacing being similar to that of the contact members 140. Preferably, when the leading edge 156 of the daughter board 152 abuts the stop member 138, each of the contacts 154 is in overlapping relation with the surfaces 150 of contact members 140. This overlap desirably achieves a slight interference fit. Once the board 152 is thus positioned, the fluid in the bladder 132 is pressurized so that the bladder walls expand. This expansion has two significant results. Each contact member 140 experiences forces which tend to urge the foot portion 142 toward the strip 122 and the intermediate portion 148 toward the leading edge 156. The contact member surfaces 150 are thereby urged into tighter, intimate mating with the board contacts 154. Thus, the pressurization of the bladder 132 enhances the electrical contact between the foot and the strip 122, and promotes an intimate contact between pad surface 150 and contacts 154.

As shown in FIG. 4, one manner of pressurizing the bladder 132 is accomplished by providing a pivot latch 164. Preferably, the strip 122 extends beyond the end 162 of bladder 132. Similarly, the end portion 160 of housing 126 extends beyond the bladder end portion 162. A cut-out 158 is formed on the upper, "short leg" surface of the housing 126. The latch 164 is also generally L-shaped, with the free end 166 of the long leg 170 secured to a pivot axle 168 which, in turn, is in fixed relation to the housing 126. The short leg 172 has a notch 174 which, when the latch member 164 is pivoted 90 degrees from the horizontal to the vertical position, mates with cut out 158. The long leg portion 170 includes, near the pivot axle 168, a cam surface 178 which presses against the exterior end 162 of the bladder 132 when the latch 164 is secured by engagement of the cut out and notch 158, 174. Preferably, a ridge 176 is provided for manipulating the latch with the thumb. The cam surface 178 pressurizes the confined fluid sufficiently to transmit a substantially hydrostatic force throughout the membrane surface of bladder 132, thereby effecting the connected arrangement shown in FIG. 3. An evenly distributed force is transferred to all of the electrical contact surfaces, thus effecting simultaneous dry-circuit contact between the daughter and mother boards.

The connector illustrated in FIGS. 2–4 may, for example, be designed with two groups of 60 contact members 140 on each side of slot 136 for a total of 240 contact pad surfaces 150 in a total package 4 inches long. The contact pads 150 are 0.013 inch×0.025 inch in size. The desired normal force is, for example, 75 grams per contact. The desired internal pressure to achieve this contact force would thus be 508 p.s.i. (75 g./(454 g/lb.×0.013 inch×0.025 inch)). Due to the nature of hydraulics, a modest pressure on end of 162 of bladder 132 results in a force multiplication. With a bladder end surface area 162 of 0.060 inch×0.240 inch and a pressure of 508 psi, the latch lever 164 need only exert 7.32 lbs. of force on each bladder 132. In order to contain the 508 p.s.i. of pressure, the connector housing 126 is formed from 0.040 inch thick steel. The hydraulic bladder 132 consist of extruded polymer tubing with various secondary forming and sealing operations. The several spacers and cams are all molded or die-cast parts. Due to the extended service life often desired in these applications, every aspect of the design can be geared to the elimination of the necessity for glues, bonding agents, and even solder.

The arrangements shown in connection with the illustrated embodiments may be modified to be used with low insertion force (LIF) front entry card edges, PCB stacking connectors, ZIF pin and socket systems and chip on board COB sockets for directly contacting the bonding pads on solid state devices without any lead frame or packaging (also referred to as "Level Five Interconnect").

It should also be appreciated that the present invention could be used to improve wiper or other interference fit contacts. For example, in FIG. 1(*a*), the first and second conductors may be oriented such that as they are moved into overlapping relationship, they establish a slight interference fit, and thereafter, the fluid bladder is actuated to lock them into intimate engagement.

Figure 6:
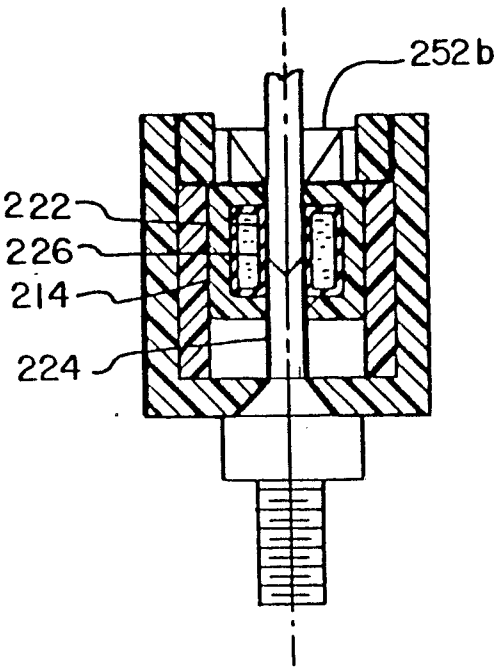
FIG. 6 is view similar to FIG. 5 but with the chassis connector in the closed position to achieve the high pressure, compliant connection.
Figure 5:
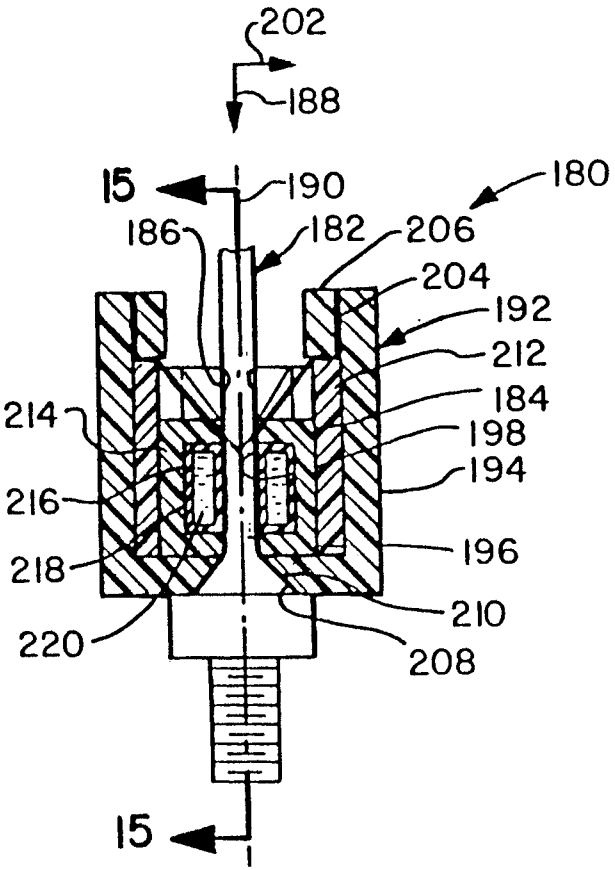
FIG. 5 is a section view of another embodiment of the invention directed to a chassis with a ZIF card edge connector, somewhat similar to the type shown in FIG. 2, including a further improvement for implementing the intimate, compliant connection between flex circuit conductors in the chassis and corresponding conductors on the card edge, showing the card edge in the initially inserted position and the chassis connector in the open position.

FIGS. 5 and 6 show another surface mount edge connection 180 for a card 182 having a leading bevelled edge 184 and a plurality of edge conductors 186. For convenient reference, the direction of insertion of the card 182 into the chassis connector 192 will be referred to as the first direction 188. The card is inserted along chassis centerline 190, into the generally U-shaped housing 194 until the edge 184 seats in a V-groove in non-conducting central rib 196. The connector 192 extends longitudinally into and out of the plane of the paper which will be referred to as the second direction 200 (see FIG. 7). The mutually perpendicular direction in the plane of the paper of FIG. 13 will be referred to as the third direction 202. It should thus be appreciated that the edge conductors 186 each extend along the first direction 188 and are spaced apart from each other along the second direction 200.

In FIG. 5, the card 182 is fully seated in the rib 196, but none of the edge conductors 186 is in contact with the respective chassis conductors 198. The chassis conductors 198 also extend generally in the first direction and are spaced apart in the second direction, but they are preferably quite flexible. The conductors 198 are secured at their upper ends 204 between a non-conducting bar 206 and housing 194 and at their lower ends 208, they are secured between tapered mating surfaces 210 at the base of the rib 196 and housing 194.

A non-conducting spacer bar 212 extends in the second direction along the vertical leg portions of housing 194 between the bar 206 and the base portion of the housing. Gland member 214 extends longitudinally in the second direction and is confined on three sides by wall means 216 defining a recess for the bladder in the gland member. The bladder 218, while retained in the gland 214, has an active exterior surface 226 which, in the illustrated embodiment, is in direct contact with each chassis conductor 198. The bladders 218 are filled with an incompressible fluid 220.

In accordance with the present invention, after the card edge 184 is in place on rib 196, the gland 214 is raised in the direction opposite to arrow 188, such that the chassis flex conductors 198 are reshaped into the form shown in FIG. 6. In FIG. 6, it is evident that the flex conductors 198 are now in contact with their respective edge conductors 186 as shown at 222.

Figure 14:
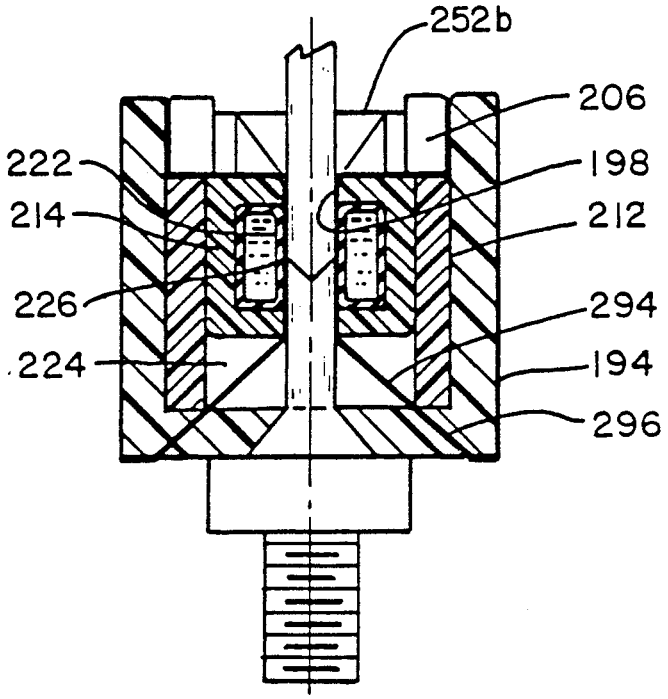
FIG. 14 is a section view similar to FIG. 5, showing the preferred manner of supporting the chassis flex conductors.

FIG. 14 illustrates the preferred embodiment wherein the lower portions 294 of the chassis flex conductors 198 are secured to the housing 194 in a manner generally symmetric with the securement of the upper portion of the conductor 198 between the bars 206,212. Preferably, the lower portion of the conductor 198 is secured at 296 below bar 212 and through corner of housing 194. This assures adequate flexibility for accommodating the vertical movement of the gland 214.

The vertical travel of the gland 214 and associated bladder is made before the bladder is pressurized, so that alignment of the conductors 186 and 198 and resulting low force wiping will not damage the flex circuits 198. Thus, the first step associated with the transition from the arrangement shown in FIG. 5 to that shown in FIGS. 6 or 14 is the displacement of the gland member a predetermined distance between a position in which the conductors 186, 198 are not in contact to a position in which the conductors are in substantially pressureless contact.

From this condition of substantially pressureless contact between the conductors, the confined, constant volume fluid 220 in the bladder 218 is pressurized to sustain a high pressure, compliant, intimate contact between the conductors 186 and 198. This pressurization is preferably achieved by applying a force within a predetermining range to an exterior portion of the bladder remote from the conductors. Due to the initial step of achieving pressureless contact, the fluid displacement required in the bladders is very small as the pressurization relies on the force multiplication of the confined fluid in the bladder.

Figure 12:
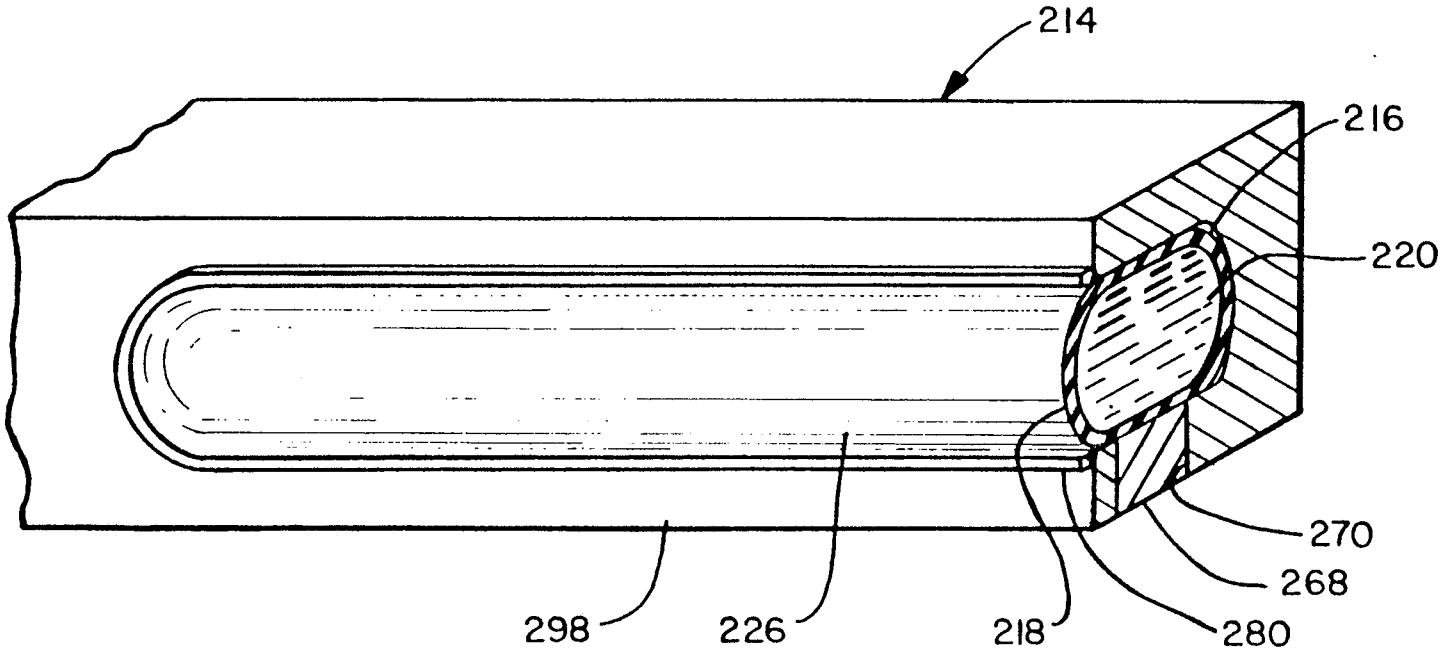
FIG. 12 is a sectioned perspective view of the gland and bladder, including a fence framing the bladder to prevent extrusion when pressurized.
Figure 13:
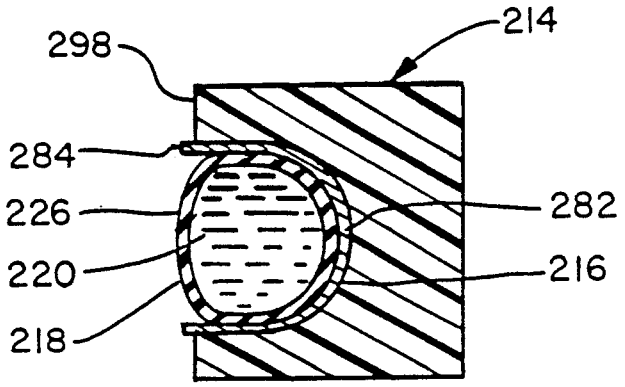
FIG. 13 is a section view showing an alternative implementation of the fence around the bladder.

FIGS. 12 and 13 illustrate two alternative techniques for preventing extrusion of the external surface 226 of bladder 218, laterally, i.e., parallel, to the face 298 of gland member 214 which confronts the surface of card 182. In one embodiment, substantially rectangular segments of a fence or rail 280 are attached as by extrusion bonding to the front face 298 of the gland 214 as a border or frame around the opening of gland recess 216. Alternatively, a trough-like insert 282 is placed in recess 216 to cradle the bladder 218, with lip portions 284 extending from the front face 298 as a frame or border. Preferably, the frame or border 280,284 is made of a high strength but somewhat flexible material which projects from surface 298 approximately 0.010 inch. The front surface 226 of the bladder should project approximately the same distance from the gland surface 298 as does the fence 280,284. The projection of the fence is approximately equal to the tolerances associated with the thickness of board 182.

Figure 15:
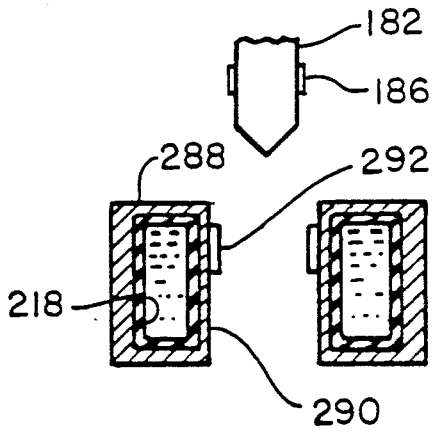
FIG. 15 is a schematic view of the gland member and card in an alternative embodiment that does not employ the flex chassis conductors of FIG. 14.

FIG. 15 shows a variation of the connector whereby a thin, compliant membrane 290 could be interposed between the bladder 218 and the chassis conductors 198. This membrane helps retain the bladder within the gland member, and is thin enough to transmit the hydrostatic force to the conductors 198,186. In a variation of this embodiment, the membrane 290 carries the chassis conductors 292 directly thereon, so the flex-type conductors 198 need not be used. The initial wiping and then firm, compliant, pressurization are similar to the previously described embodiment.

FIGS. 7–11 illustrate the preferred structure for implementing the multi-step technique described above with respect to FIG. 5, 6, 14 and 15. The preferred actuating mechanism 228 includes a guide member 230 which is movable in the second direction 200 relative to the chassis base 232. The chassis 232 includes an anchor member 234 containing a pivot pin 236 which is secured to latch lever 238. The lever arm 240 is adapted to be manually rotated through the various positions shown in FIGS. 8–11. The latch lever controls a profiled cam surface 242 which, in the illustrated views, lies between the arm 240 and the guide member 230. The cam surface 242 (or spring member 266 carried thereon) is located so as to interact with the gland 214, which also lies between the arm 240 and the guide 230. The guide 230 has a lower ledge 244 including a notch 246 for receiving a pin 248 projecting from the latch lever 238. The pin 248 is confined within notch 246 but may "float" therein according to the rotational position of the latch lever 238 about pin 236.

Figure 7:
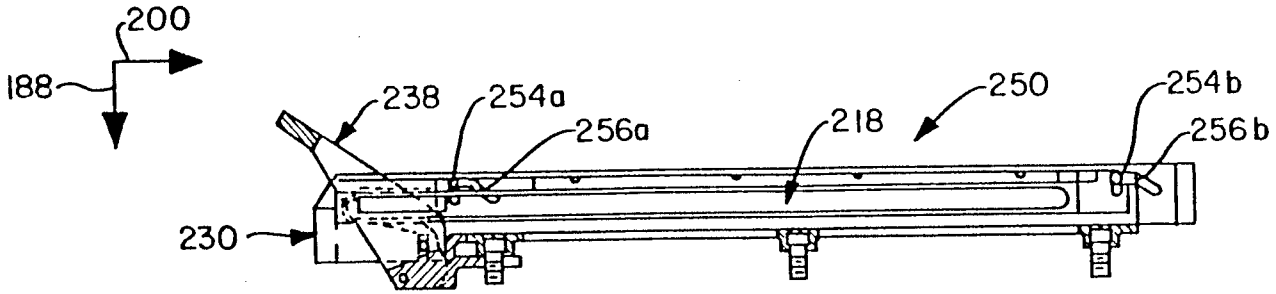
FIG. 7 is a side view of the connector of FIG. 5, sectioned on the connector centerline, but with the flex circuits and central rib on which the card abuts omitted for clarity.

As shown in FIG. 7, the guide member 230 extends in the second direction a distance greater than the longitudinal extend of the card in the second direction. The longitudinal extent of the card, particularly the extent of the edge conductors on the card in the second direction, is indicated as the contact area 250 in FIG. 7. The actuation mechanism described with reference to FIGS. 8–11 is located beyond the card at the left of FIG. 7. Some associated structure for supporting the movement of the guide 230 also is located beyond the active region on the right as shown in FIG. 7. The upper ledges 252A, 252B on guide member 230 include cam slots 256A, 256B respectively, each of which includes a sloped region 258 and a horizontal dwell region 260. Corresponding positioning pins 254A and 254B are carried by the gland 214.

The following description explains how the latch lever 238 produces firstly, a displacement of the guide member 230 in the second direction and a corresponding lift in the gland member 214 opposite to the first direction 188, followed by a pressurization of the bladder. The connector open position shown in FIG. 8 corresponds to the open position of the connector shown in FIG. 5. The rotation of the latch lever 238 through approximately one quarter of its throw, to the position shown in FIG. 9, has the effect of displacing guide member 230 toward the right. Simultaneously, the transfer of actuating force from the first cam surface 262 to the second cam surface 264 raises the gland 214 relative to the guide member 230. The movement of the guide 230 to the right drives the positioning pin 254 upwardly in cam slot region 258, but the profiled surfaces 262, 264 do not produce high pressure against the gland 214.

Figure 10:
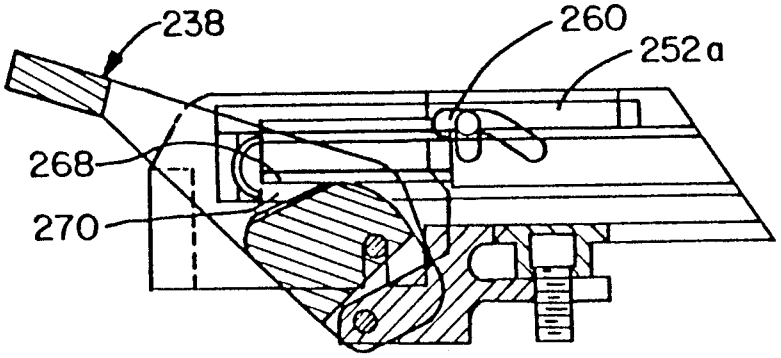
FIG. 10 is a view similar to FIG. 9 showing the lever rotated approximately three-quarters, with the positioning pin having moved to the dwell region of the cam slot whereby the gland member has been raised to the position shown in FIG. 6.

As shown in FIGS. 10 and 12, a portion of the gland 214 serves as a pressure plug 268 for pressurizing the bladder 218 and such pressurization should not occur prematurely, i.e., pressurization during the lifting of the gland is to be avoided. Such pressurization is desired in the transition between FIGS. 10 and 11 where the third profiled surface 242 which preferably carries or is formed as a spring surface 266, penetrates a window or the like 270 in the wall of the gland 214 so as to bear against an exterior surface of the bladder that is within recess 216 but remote from the front surface 226 that bears on the conductor contacts. This occurs while a positioning pin 254 is in the dwell region 260 of the cam slot, so that although the guide member 230 continues to move in the second direction, the gland is stationary while the bladder is being pressurized.

In the embodiment illustrated in FIG. 13, the portion of the sleeve 282 resting in recess 216 is in the form of narrow webs that occur at laterally spaced intervals along the bladder, thereby leaving most of the bladder exposed to the plug 268 or the like which enters the recess to pressurize the bladders. It should be appreciated that in the transition between the condition shown in FIG. 8 and the condition should in FIG. 9, the lifting of the gland member 214 relative to the guide member 230 is affectuated by the "pushing up" on the plug 268 by the second cam surface 264. Since the gland member 214 is not vertically restrained during this transition, there is relatively little increase in the internal pressure of the gland member 218, but even this small increase in pressure contributes to the wiping contact achieved between the chassis and board conductors.

Figure 11:
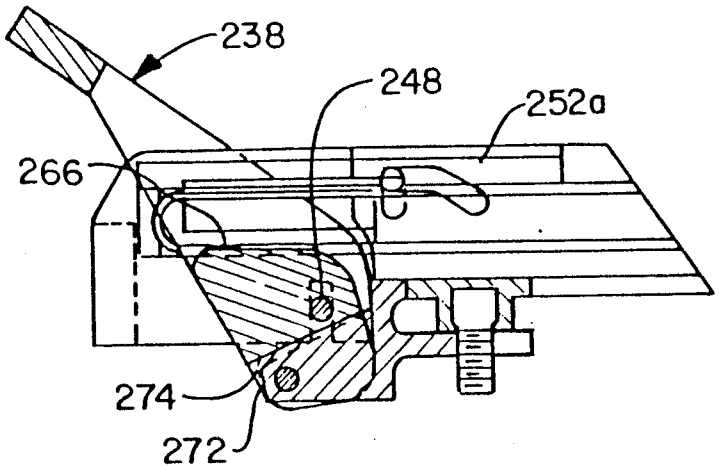
FIG. 11 is a view similar to FIG. 9 showing the lever rotated to its fully latched position whereby pressure plugs have been driven against a portion of the bladder through windows in the gland, thereby squeezing the bladders to create a high pressure intimate contact between the chassis and card conductors.

FIG. 11 corresponds to the condition shown in FIG. 6 with the latch lever fully rotated and the spring surface 266 bearing directly or indirectly via plug 268 against an exterior portion of the bladder. It may be appreciated that due to the particular linkage among the anchor 234 and its associated nose portion 272, the latch lever 238 and associated thrust surface 274 bearing on nose portion 272, and the pivoting effects of pins 236 and 248, the arrangement operates somewhat like a toggle or overcenter latch so that once rotated to the position shown in FIG. 11, the latch lever remains therein so as to maintain the pressure on the bladder. A positive resistance must be overcome to return the latch lever 238 to the other positions shown in FIGS. 8–10. In particular, the latch lever 238 operates so that the maximum insertion of plug 268 into recess 216 occurs when the lever 238 is in the position shown in FIG. 10, whereby as the lever 238 is further advanced to the locked position shown in FIG. 11, the pressure on the bladder is decreased slightly.

Figure 9:
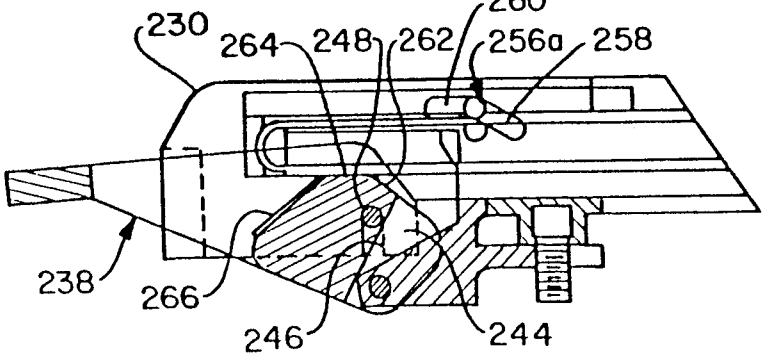
FIG. 9 is a view similar to FIG. 8, showing the connector actuating lever in a partially rotated position wherein a positioning pin on the gland which carries the bladder, has moved up in the cam slot.

This toggle effect is due in part to the fixed relationship of pivot pin 236 and the floating pin 248 in movable notch 246. Initially, the notch 246 is above and to the left of pivot pin 236. As the lever 238 is rotated clockwise, the relationship between pivot 248, pivot 236, and arm 240 remain constant, since the pivots 248 and 236 are fixed with respect to arm 240, but the relationship of guide 230 and associated notch 246, to the pivots 248 and 236 changes. During this transition from FIGS. 8 to 11, the guide 230 and, in particular, notch 246, travels from left to right such as the bladder is pressurized, the notch has passed from a position just to the left of vertical relative to pin 236 as shown in FIG. 9, to a position to the right of vertical shown in FIG. 11.

Figure 8:
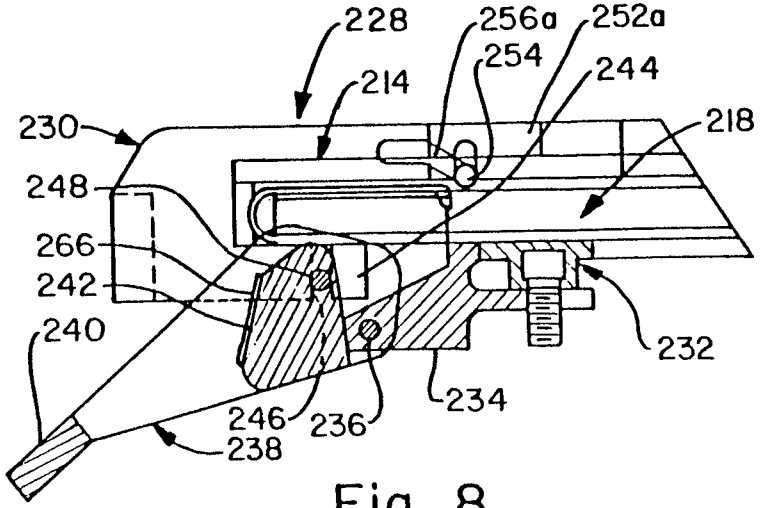
FIG. 8 is an enlarged view of a portion of the connector shown in FIG. 7, in the open position corresponding to FIG. 5.

This lever action coordinates the movement of pin 254, which is movable vertically in its slot relative to the chassis 232, but not horizontally. The vertical slot is fixed with respect to the chassis, whereas the cam slot 256A having the horizontal dwell portion nearer the latch lever 238 and the downward sloping portion 258 away therefrom, is formed in the guide member 230. The difference in vertical elevations of cam surfaces 262 and 264 between the lever orientations in FIGS. 8 and 9, is approximately equal to the vertical extent of the chassis cam slot in which pin 254 is located. The vertical elevation of the third cam surface 242 and/or associated spring 266, is higher than that of cam surface 264, as shown in FIG. 11, whereby the cam surface 242 or 266 bears against and lifts plug 268, while the gland member 214 is restrained from further vertical movement by the pin 254 bearing against the upper wall of the horizontal portion of slot 260.

It should be appreciated that in the embodiment of the invention shown and described with respect to FIGS. 5–11, the connector is adapted to receive a card having edge conductors 186 on both sides of the card. Accordingly, the respective chassis conductors 198, glands 214 and associated bladders 218 are provided in pairs, but this arrangement could readily be modified, if desired, to accommodate a card having conductors 186 on only one side.

In one implementation of the card edge connector embodiment shown in FIGS. 7–11, actuation with the latch lever requires about 2.5 lbs. of user force to mate 240 contacts. The hydraulic pressure created is 508 lbs./sq. in., yielding a normal force of 80 grams/contact. It also produces a light pressure wiping action during the transition between FIGS. 8 and 9 to help remove any contaminants which may be present. Bladders made of polymer tubing filled with a fixed volume of hydraulic fluid can be pressurized and depressurized to more than 1,000 psi for well over 20,000 cycles with no discernible degradation of the parts. The fluid displacement is very small, slightly under 0.002 cu. in. in the bladder. The cams as supplemented by the constant force bearing spring surface 266, generates 7.4 lbs. per bladder, with the 15 lbs. total resulting from the mechanical advantage of the lever. In this preferred embodiment, the light wiping at zero insertion force, with the use of the flex circuit conductors on the connector, permit absolute impedance matching. The flex circuit conductors are protected in that gross relative motion between the card edge and the chassis conductors is accomplished without excessive friction or interference between the conductors. After this substantially pressureless contact, high pressure actuation is accomplished without movement or significant expansion of the bladder, i.e., the high pressure is achieved in a hydrostatic manner, and not by dynamic movement. The expansion of the bladder is infinitestimal, because the bladder is fully confined prior to the application of the pressurizing force, whereupon it transmits the high pressure hydrostatically to the conductors. Any expansion would be incidental and result from the filling of minuscule corners and the like in the recess walls which confine the bladder. Thus, the second step of the actuation procedure in accordance with the preferred embodiment, is, in essence, static, rather than dynamic, with respect to the gland and bladder.

The force balanced actuation, such as by the use of a spring 266 between the bladder 218 and the cam surface 242 on the latch lever, further assures that a predetermined sufficient but not excessive pressure increase will be supplied to the bladder. The balanced force embodiment of the invention is superior to a pure displacement actuation system, in that the range of spring displacement that provides adequate pressurization of the bladder, allows the connector to function over a wide temperature range and to accommodate tolerances and other changes during the life of the connector. The force balancing is facilitated by the initial step of achieving pressureless or low force wiping contact before significant loading of the spring.

It should be appreciated that, although the preferred embodiment includes pressurization of a bladder, the cam actuating carriage assembly shown in FIGS. 5–11, 14 and 15, can be advantageously utilized in a number of applications even without the pressurization of a bladder per se. The wiping action between the chassis conductor and the card conductor prior to pressurization of the bladder, is itself accomplished in a novel and effective manner, and can be implemented using the chassis flex conductors of FIG. 14, the conductors carried by the gland member as shown in FIG. 15, or other arrangement which implement the basic principle of the present invention, i.e., zero insertion force on the board or card conductors, with the subsequent "pressureless" wiping by the displacement of the gland member relative to the board. Furthermore, it should be appreciated that the cam actuation which in the previous embodiment is utilized to pressurize the bladder, may also be employed without a fluid filled bladder, to urge the chassis conductors into locked relation with the card conductors after the low pressure wiping.

A further advantage of the present invention is that different contact pitches in the same connector body need only involve the production of different flex circuits. Mixing power and signal contacts, impedance matching of the contacts with the system requirements, and various other "custom" design considerations, can all be accommodated by the same technique.

Figure 17:
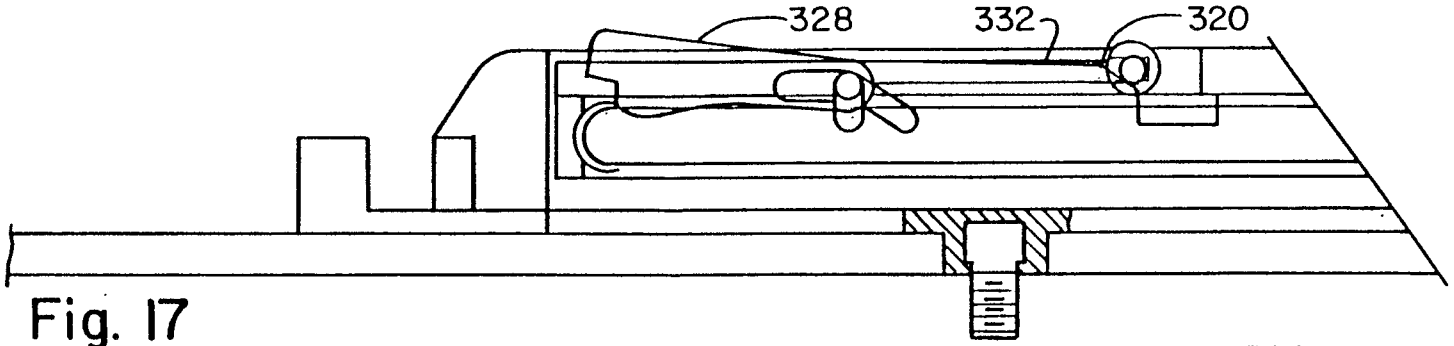
FIG. 17 is a side view of the connector of FIG. 16 in an intermediate position.
Figure 18:
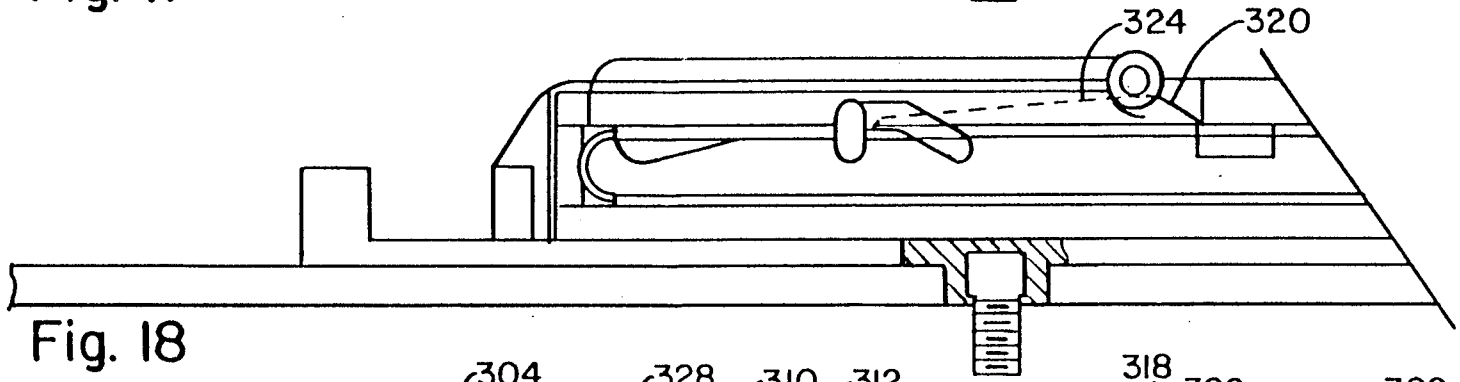
FIG. 18 is a side view of the connector of FIG. 16 in the fully locked position.
Figure 16:
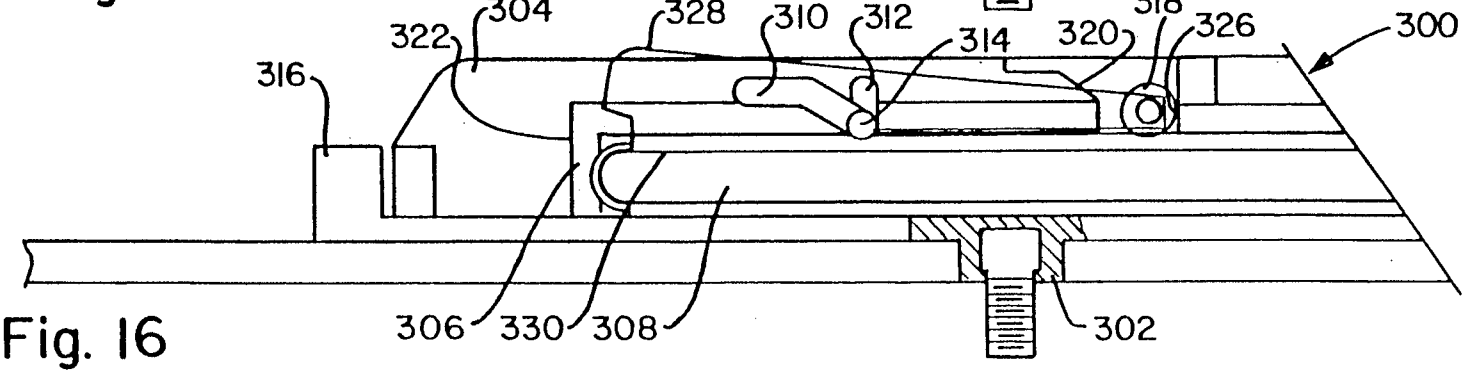
FIG. 16 is a side view similar to FIG. 8, showing an alternative embodiment of a cam actuated connector in the open position.

FIGS. 16–18 illustrate another embodiment of the cam actuated connector for effectuating the same type of connection illustrated in FIGS. 7–15 when, for reasons such as board orientation or configuration, an actuating latch cannot be rotated in the plane of the drawing sheet of FIG. 8. FIG. 16 shows the connector 300 in the initial open position, FIG. 17 shows it in an intermediate position, and FIG. 18 in the fully locked position. A number of components are analagous to those shown in the previous embodiment, including the chassis 302 and the associated guide member 304, in which the gland member 306 and bladder 308 are situated. The guide member 304 has a cam slot 310 in which the pin 314 of the gland member 306 is located, the pin 314 also being vertically movable within slot 312 associated with the chassis. The actuating arm 316 is not mounted for rotary movement in the plane of the drawing, but rather for linear movement to the left and right in the plane of the paper.

The arm 316 is directly or indirectly connected to roller 318 so that as arm 316 is moved to the left or the guide 304 is displaced to the right, as by a bell crank linkage (not shown) to arm 316, the roller 318 rises on the first cam surface 320. The distance from the arm 316 to the front edge 322 of gland member 306 remains constant, as does the distance from the front edge 322 of the gland to the roller 318, whereas the guide member 304 is moveable laterally with respect to both the arm 316 and the roller 318. Since the pin 314 is also effectively fixed via link 332 with respect to the roller 318, as arm 316 is moved to the left, pin 314 travels obliquely upward on race 310, while moving upwardly within slot 312, and the roller 318 climbs up on first cam surface 320, thereby lifting the gland member 322 to which pin 314 is rigidly secured. The first cam surface 320 is associated with the guide member 304, and link segment 332 is pivotally connected to roller 318 and to pin 314 on the gland member 306.

As best shown in FIG. 18, a second cam surface 324 slopes downward and toward pin 314, whereas the first cam surface 320 slopes upward and toward pin 314. Lever 328 is pivotally connected to the pin 314 at one end and, in effect, rides on the gland member 306 at the other free end. The lever 328 includes a lower profiled surface 330 which rests either directly on the bladder portion 308, or on a plug such as 268 depicted in FIG. 12.

In general, as the gland member 306 rises with respect to the guide 304, the lever 328 rises without substantial resistance along with the gland 306, until the pin 314 reaches the dwell region in race 310, as shown in FIG. 17. Further actuation of the arm 316 then raises roller 318 over the peak at the juncture of cam surfaces 320 and 324, but since pin 314 cannot also rise further within the cam slot 310, the profiled surface 330 bears with increased force against the bladder 308 (or plug associated with the gland member) to provide the fluidic, hydrostatic pressurization and securement of the chassis and board conductors.

As with the previously described embodiment, the surface 330 preferably has spring means associated therewith for applying a total force on bladder 308 that is within a desired range despite imprecise alignments and tolerances. Variations of this embodiment should be apparent to practitioners in this field.

It is within the scope of the invention to provide a separate compliant membrane and fluidic actuator, where that might be advantageous. It should be further understood, however, that an important advantage of the invention relates to the compliant transmission of the fluid pressure through the membrane, approaching ideally the application of the hydrostatic pressure of the fluid to the second conductor. In many applications of the present invention, the pressure desired at the mating surfaces between the contacts of the first and second conductors, is in the range of about 400–1600 p.s.i. The fluid pressure within the bladder required to generate this specific pressure at the contact points, is typically large enough to produce compliant behavior in membranes from the materials listed above and their equivalents.

I claim:

1. An electrical connector comprising:

a chassis adapted to receive a multi-conductor member insertable along a first direction into a slot in the chassis extending along a second direction;

a gland member mounted in the chassis and extending longitudinally in the second direction;

a plurality of chassis conductors corresponding respectively to the conductors on the multi-conductor member, the chassis conductors being at least partly interposed between the gland member and said slot;

means connected between the chassis and the gland member, for displacing the gland member from a first position wherein the conductors on the multi-conductor member and in the chassis are spaced apart to a second position wherein the conductors are in respective low pressure contact;

a bladder member filled with incompressible fluid carried by the gland member and movable therewith such that when the gland member is in the second position the bladder is in low pressure contact with the chassis conductors; and means for applying a predetermined force on a predetermined external portion of the bladder after the gland member has moved to the second position, whereby the bladder sustains a predetermined high pressure compliant contact between each aligned conductor.

2. The connector of claim 1, wherein said means for displacing displaces the gland member a predetermined distance.

3. The connector of claim 2, wherein said means for displacing displaces the gland member in one direction either opposite to said first direction or in a third direction perpendicularly to said first and second directions.

4. The connector of claim 1, wherein said means for displacing includes a cam guide having a cam race engaging a cam pin on the gland member, and an actuating member pivotally connected between the chassis and the cam guide.

5. The connector of claim 4, wherein the cam guide extends in the second direction parallel to the gland member, and the cam pin and cam race interact such that when the cam actuator is pivoted from an initial position to an intermediate position the cam guide moves in the second direction and the gland member moves opposite to the first direction.

6. The connector of claim 5, wherein said means for applying a predetermined force include a profiled surface on the cam actuating member such that as the actuator is moved from the intermediate position to a latched position, the profiled surface bears on said external portion of the bladder to generate the high bladder pressure.

7. The connector of claim 5, wherein the increase in pressure in the bladder is transmitted to the conductors in a third direction substantially perpendicular to the first and second directions.

8. The connector of claim 6, including a spring interposed between the profiled surface and the bladder exterior portion, such that the spring establishes a force within a predetermined range applied by the profiled surface against the bladder external portion when the cam actuator is in the latched position.

9. The connector of claim 1, wherein the chassis conductors and the conductors on the multi-conductor member are each oriented in the first direction and are spaced apart in the second direction, and the chassis includes locator means for receiving the multi-conductor member within the chassis such that the conductors on the multi-conductor and the respective chassis conductors are aligned in said first direction.

10. The connector of claim 9, wherein the chassis conductors are in the form of flexible segments connected to the chassis at each segment end, and the gland member is adapted to be displaced in parallel to the first direction so as to displace at least a portion of each segment into contact with a respective conductor on the multi-conductor.

11. The connector of claim 1, wherein said means for displacing and said means for applying a force includes a cam guide having a first cam race engaging a cam pin on the gland member, a manually displaceable actuating member for moving the guide in the second direction, a stationary second cam race associated with the chassis and lever means including a roller following the second cam race and a lever responsive to the movement of the roller on the second cam race and the cam pin in the first cam race, for bearing on the bladder.

12. The connector of claim 11, wherein the lever means include a rigid link segment pivotally connected to the roller and to the cam pin, and a lever segment having one end pivotally connected to the cam pin and a free end bearing on the bladder.

13. The connector of claim 1, wherein said gland member includes means surrounding the bladder member for preventing lateral extrusion of the bladder member when said force is applied to said bladder member.

14. The connector of claim 13, wherein said means for preventing the extrusion include a frame projecting outwardly from said gland member a distance of up to about 0.010 inch.

15. The connector of claim 13, wherein said bladder member projects from said gland member a distance approximately equal to the projection of said means from said gland member.

16. An electrical connector comprising:

a chassis having a slot adapted to receive a substantially flat multi-conductor member extending substantially in a plane along first and second directions when carried in the slot, which extends along the second direction;

a gland member mounted in the chassis and extending longitudinally in the second direction;

a plurality of chassis conductors corresponding respectively to the conductors on the multi-conductor member, the chassis conductors being at least partly interposed between the gland member and said slot;

the chassis conductors and the conductors on the multi-conductor member each being oriented in the first direction and spaced apart in the second direction;

locator means associated with the slot for orienting the multi-conductor member within the slot such that the conductors on the multi-conductor and the respective chassis conductors are aligned in said first direction;

means connected between the chassis and the gland member, for displacing the gland member along said first direction, from a first position wherein the conductors on the multi-conductor member and in the chassis are spaced apart to a second position wherein the conductors have experienced respective low pressure wiping contact; and means associated with the gland member for urging the chassis conductors toward the multiconductors after the gland has moved to the second position.

17. The connector of claim 16, wherein the chassis conductors are in the form of flexible segments connected to the chassis at each segment end, and the gland member is adapted to be displaced in parallel to the first direction so as to displace at least a portion of each segment into wiping contact with a respective conductor on the multi-conductor.

18. The connector of claim 16, wherein the chassis conductors are carried by the gland member and the gland member is adapted to the displaced in parallel to the first direction so as to displace each chassis conductor into wiping contact with a respective conductor on the multi-conductor.

19. The connector of claim 16, wherein said means for displacing moves the gland member a predetermined distance.

20. The connector of claim 16, wherein said means for displacing includes a cam guide having a cam race engaging a cam pin on the gland member, and a manually operated actuating member connected between the chassis and the cam guide.

21. The connector of claim 20, wherein the cam guide extends in the second direction parallel to the gland member, and the cam pin and the cam race interact such that when the cam actuator is moved from an initial position to an intermediate position, the cam guides moves along the second direction and the gland member moves along the first direction.

22. The connector of claim 21, wherein said means for urging the chassis conductor toward the multi-conductor includes a profiled surface responsive to movement of the cam actuator such that as the actuator is moved from the intermediate position to a latched position, the profiled surface bears against means carried by the gland member for transferring said force to the chassis conductors.

23. The connector of claim 22 including a spring interposed between the profiled surface and the means for transmitting force, such that the spring establishes a range of predetermined force supplied by the profiled cam surface against said means for transfering force when the cam actuator is in the latched position.

24. The connector of claim 16, wherein said means for displacing includes a cam guide having a cam race engaging a cam pin on the gland member, and an actuating member pivotally connected between the chassis and the cam guide.

25. The connector of claim 24 wherein the cam guide extends in the second direction parallel to the gland member, and the cam pin and cam race interact such that when the cam actuator is moved from an initial position to an intermediate position, the cam guide moves along the second direction and the gland member moves along to the first direction.

26. The connector of claim 25 wherein the actuating member is pivotally connected to the chassis and includes a stud member rigidly connected to the actuating member and located within a notch in the guide member, said notch extending substantially parallel to the first direction;

the cam race in the guide member has a dwell region extending substantially in the second direction and a riser region connected to the dwell region and extending obliquely downwardly in the first direction; and said chassis includes a cam slot extending in said first direction in which said cam pin is free to slide as the cam pin travels along said cam race.

27. The connector of claim 26, wherein the actuating member includes three serially connected cam surfaces, and the first cam surface is in contact with the gland member when the cam actuator is in the first position, the second cam surface is arranged to lift the gland member relative to the guide member when the actuation member is in the intermediate position, and the third cam surface is arranged to apply a pressure against the gland member while the gland member is restrained by the cam pin from movement parallel to said first direction.

28. The connector of claim 27, wherein the stud is located relative to the pivot pin such that as the actuation member is rotated from the first position to the third position, the notch is displaced in said second direction from one side to another side of a line passing through the axis of the pivot pin, along the first direction.

29. A method for joining two signal conductors comprising:

supporting a first conductor against a first backing member;

supporting a second conductor in spaced alignment with the first conductor by a movable gland member including a bladder having a compliant membrane filled with a substantially constant volume of fluid;

positioning the gland member so that the second conductor is in low pressure contact with the first conductor, by moving the gland member so that the second conductor moves with low force wiping contact against the first conductor;

after the step of positioning and while the second conductor is in low pressure contact with the first conductor, applying a predetermined pressure to the exterior of the bladder whereby the pressure is transmitted through the membrane to the second conductor and against the first conductor to sustain a high pressure compliant connection therebetween.

30. The method of claim 29, wherein the second conductor is a flexible, linear conducting segment secured at its ends, and the steps of supporting the second conductor include;

supporting the second conductor with the gland member while the second conductor is in spaced alignment in the linear direction from the first conductor and displacing the gland member in the linear direction to move the second conductor into low force wiping contact with the first conductor while the gland member is positioned against the second conductor.

31. The method of claim 29, wherein the steps of moving the supported second conductor include the step of manually displacing an actuating arm from a first position to a second position, and the step of applying a predetermined pressure includes the step of further displacing the actuating arm from the second to the third position.

* * * * *